US011054101B2

(12) United States Patent
Araki et al.

(10) Patent No.: US 11,054,101 B2
(45) Date of Patent: Jul. 6, 2021

(54) LIGHTING DEVICE

(71) Applicant: Panasonic Intellectual Property Management Co., Ltd., Osaka (JP)

(72) Inventors: Yosuke Araki, Osaka (JP); Ryoma Murase, Osaka (JP); Kazumasa Takata, Osaka (JP); Jun Hirai, Nara (JP); Hiroshi Umiji, Hyogo (JP); Hiroshi Hamano, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/998,779

(22) Filed: Aug. 20, 2020

(65) Prior Publication Data

US 2021/0088194 A1 Mar. 25, 2021

(30) Foreign Application Priority Data

Sep. 25, 2019 (JP) ..... JP2019-173720

(51) Int. Cl.

| | |
|---|---|
| ***F21S 41/25*** | (2018.01) |
| ***F21V 5/00*** | (2018.01) |
| ***F21V 3/02*** | (2006.01) |
| ***F21S 41/30*** | (2018.01) |
| ***F21S 41/143*** | (2018.01) |
| *F21W 102/135* | (2018.01) |
| *F21Y 115/10* | (2016.01) |

(52) U.S. Cl.

CPC ..... *F21S 41/25* (2018.01); *F21S 41/143* (2018.01); *F21S 41/30* (2018.01); *F21V 3/02* (2013.01); *F21V 5/008* (2013.01); *F21W 2102/135* (2018.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 2016/0290583 | A1* | 10/2016 | Suwa | F21S 41/43 |
| 2017/0122528 | A1* | 5/2017 | Kadoriku | F21S 41/24 |
| 2018/0347776 | A1 | 12/2018 | Matsuda et al. | |
| 2019/0137066 | A1 | 5/2019 | Kasano et al. | |

FOREIGN PATENT DOCUMENTS

| | | |
|---|---|---|
| JP | 2012-054150 | 3/2012 |
| JP | 2013-073811 | 4/2013 |
| JP | 2017-212112 | 11/2017 |
| JP | 2018-206600 | 12/2018 |

* cited by examiner

*Primary Examiner* — Elmito Breval

(74) *Attorney, Agent, or Firm* — Wenderoth, Lind & Ponack, L.L.P.

(57) ABSTRACT

A lighting device includes a light emitting element; a first lens that receives light emitted from the light emitting element and emits first emission light; and a second lens that receives the first emission light and emits second emission light. The first lens has a first emission surface emitting the first emission light, the first emission surface having a convex shape protruding in a Z direction.

15 Claims, 3 Drawing Sheets

LIGHTING DEVICE

BACKGROUND

1. Technical Field

The present disclosure relates to a lighting device having a cutoff function.

2. Description of the Related Art

In the related art, there is a lighting device having a cutoff function. For example, in a floodlight or the like used for an outdoor ground, light emitted in a predetermined direction is cut so that the light does not leak to a peripheral portion of the ground.

In Japanese Patent Unexamined Publication No. 2018-206600, the light incident on an upper portion of a first lens is reflected downward by a second reflection surface formed on the first lens and light incident on an upper portion of the second lens is cut. The light reflected by the second reflection surface is superposed on the light not reflected by the second reflection surface and is incident on a lower portion of the second lens. Since the second lens has a convex light incident portion, the light incident on a side wall (side surface portion) of the second lens can be reduced. Therefore, in Japanese Patent Unexamined Publication No. 2018-206600, stray light and a decrease in optical efficiency are prevented.

SUMMARY

In order to achieve the object described above, a lighting device according to one aspect of the present disclosure includes a light emitting element; a first lens that receives light emitted from the light emitting element and emits first emission light; and a second lens that receives the first emission light and emits second emission light. The first lens has a first emission surface emitting the first emission light. The first emission surface has a convex shape protruding in a traveling direction of the light emitted from the light emitting element.

DETAILED DESCRIPTIONS

Although an emission surface of a first lens in Japanese Patent Unexamined Publication No. 2018-206600 is a flat surface, when the first lens is formed by molding, sink marks are likely to occur on the emission surface of the first lens. In particular, when the first lens is rapidly cooled in order to shorten a manufacturing time of the first lens, the emission surface of the first lens is likely to be concave.

In a case where a second lens is formed by die molding, processing R is given to the emission surface. Although it is possible to suppress processing R by creating the second lens separately for a side surface portion and an emission surface portion, it is necessary to create a plurality of molds, which significantly increases the cost.

In a case where the emission surface of the first lens has the concave shape and processing R is given to an upper portion of the emission surface of the second lens, the light incident on the emission surface of the first lens from the light emitting element is refracted upward on the emission surface of the first lens by a concave lens effect of the first lens, and is further refracted upward on the emission surface of the second lens by processing R formed on the emission surface of the second lens. Therefore, light is emitted upward from the emission surface of the second lens, and stray light is generated.

An object of the present disclosure is to provide a lighting device having a cutoff function, which can suppress the generation of stray light while suppressing the cost.

Hereinafter, exemplary embodiments of the present disclosure will be described in detail with reference to the drawings. The description of the preferred exemplary embodiments below is merely an example in nature and is not intended to limit the present disclosure, an application thereof, or a use thereof.

Figure 1:
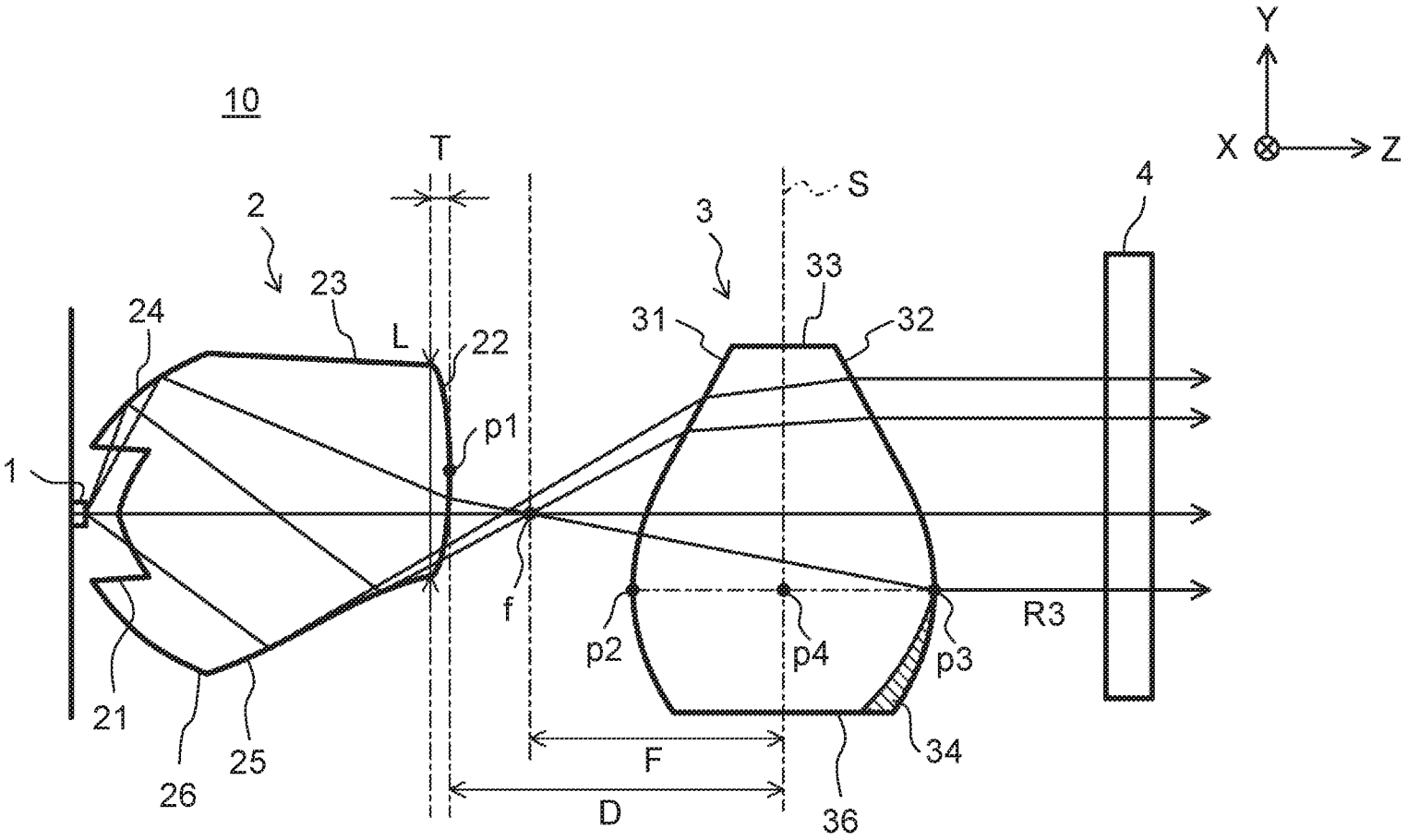
FIG. 1 is a side view of a lighting device according to an exemplary embodiment.
Figure 2:
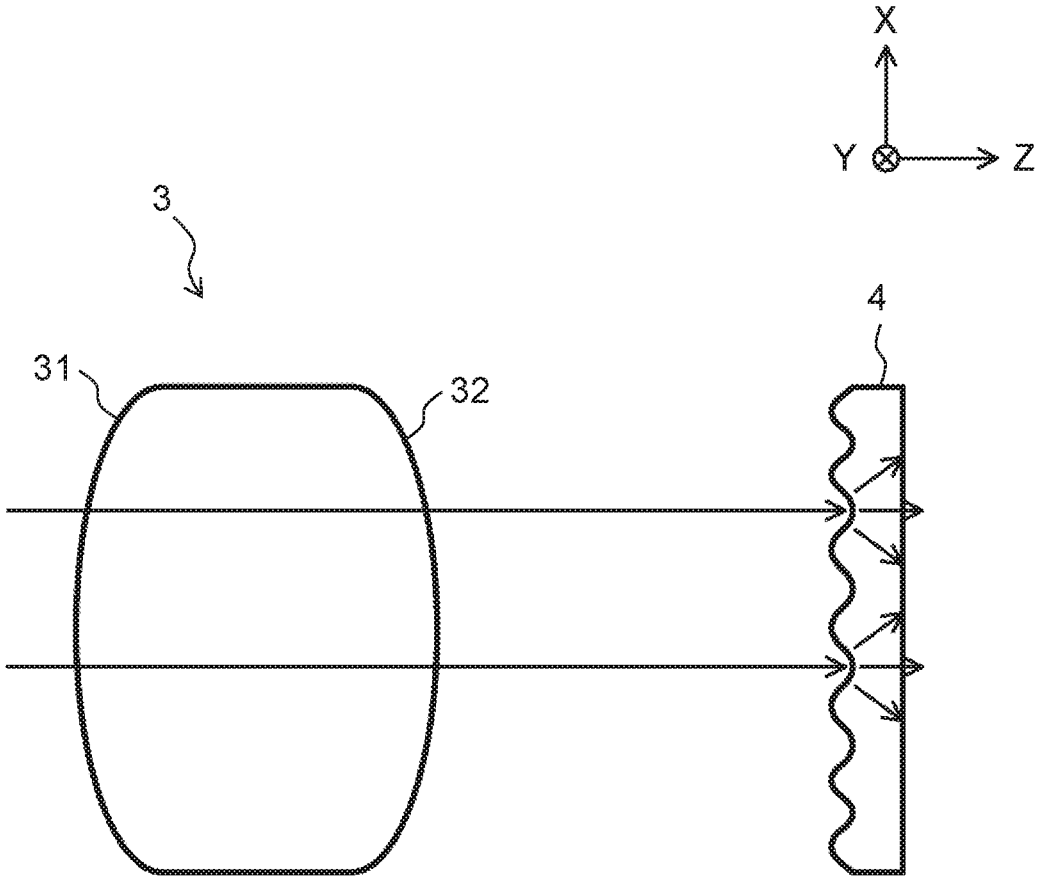
FIG. 2 is a plan view of a second lens and a diffusion plate according to the exemplary embodiment.

FIG. 1 illustrates a side view of a lighting device according to the present exemplary embodiment, and FIG. 2 illustrates a plan view of a second lens and a diffusion plate according to the exemplary embodiment. As illustrated in FIG. 1, lighting device 10 includes light emitting element 1, first lens 2, second lens 3, and diffusion plate 4. In the following description, a Z-axis represents an optical axis of light emitting element 1, and a traveling direction of light emitted from light emitting element 1 is a positive direction of the Z-axis. A Y-axis is an axis extending in a vertical direction, and an upward direction is a positive direction of the Y-axis. An X-axis represents a direction perpendicular to the Y-axis and the Z-axis. First lens 2, second lens 3, and diffusion plate 4 are respectively made of transparent resin. First lens 2, second lens 3, and diffusion plate 4 are made of, for example, polypropylene, polyethylene, polyethylene terephthalate, polyvinyl chloride, ABS resin, acrylic, polyamide, polycarbonate, Teflon (registered trademark), or the like.

Light emitting element 1 is configured of an LED or the like and has an optical axis on the Z-axis.

First lens 2 receives light emitted from light emitting element 1 and emits the first emission light to second lens 3. Specifically, first lens 2 includes first incident port 21, first emission surface 22, and first top surface portion 23 and first bottom surface portion 26 provided between first incident port 21 and first emission surface 22. First top surface portion 23 and first bottom surface portion 26 are collectively referred to as a first side surface portion.

First incident port 21 is formed on a left side of first lens 2 in the drawing, and is formed in a concave shape so as to surround light emitting element 1. First incident port 21 receives the light emitted from light emitting element 1.

First top surface portion 23 includes first reflection surface 24. First bottom surface portion 26 includes second reflection surface 25.

First reflection surface 24 is formed so as to spread from an upper end portion of an opening of first incident port 21 obliquely upward to the right in the drawing and in an X direction. First reflection surface 24 reflects the light incident on first lens 2 from first incident port 21 toward first emission surface 22 or toward second reflection surface 25.

Second reflection surface 25 is formed so as to spread from a lower end portion of first emission surface 22 obliquely downward to the left in the drawing and in the X direction. Second reflection surface 25 reflects the light incident on first lens 2 from first incident port 21 toward first emission surface 22. Second reflection surface 25 also reflects the light reflected by first reflection surface 24 toward first emission surface 22.

First emission surface 22 is formed on the right side of first lens 2 in the drawing. First emission surface 22 emits, to second lens 3, the light emitted from light emitting element 1, the light reflected by first reflection surface 24, and the light reflected by second reflection surface 25 as the first emission light. First emission surface 22 is formed so that a curvature on the X-axis and a curvature on the Y-axis are different from each other.

In first lens 2, the light emitted from light emitting element 1 toward the lower side of the drawing is reflected by second reflection surface 25 and emitted from first emission surface 22 toward the upper side of the drawing. Therefore, second reflection surface 25 cuts the light emitted from first emission surface 22 toward the lower side of the drawing.

The light emitted from light emitting element 1 toward the upper side of the drawing is reflected by first reflection surface 24 toward the lower side of the drawing, and is reflected by second reflection surface 25 toward the upper side of the drawing. Thus, the light is emitted from first emission surface 22 toward the upper side of the drawing. Therefore, the optical efficiency of lighting device 10 can be increased by first reflection surface 24 and second reflection surface 25.

Second lens 3 receives the first emission light emitted from first lens 2 and emits the second emission light. Second lens 3 is an anamorphic lens having different curvatures on the Y-axis and the X-axis.

Specifically, second lens 3 includes second incident surface 31, second emission surface 32, and second top surface portion 33 and second bottom surface portion 36 provided between second incident surface 31 and second emission surface 32. Second top surface portion 33 and second bottom surface portion 36 are collectively referred to as a second side surface portion.

Second incident surface 31 is formed on the left side of second lens 3 in the drawing, and is formed so as to be convex in the negative direction of the Z-axis. Second incident surface 31 receives the first emission light emitted from first emission surface 22 of first lens 2.

Second emission surface 32 is formed on the right side of second lens 3 in the drawing, and is formed so as to be convex in the positive direction of the Z-axis. Second emission surface 32 emits the light incident on second lens 3 as the second emission light.

Lens processing portion 34 is provided on a lower side (lower portion of second emission surface 32) of second lens 3 in the drawing. Lens processing portion 34 is a portion to which R is given on second emission surface 32 in a case where second lens 3 is created by integral molding. The light emitted from first emission surface 22 of first lens 2 becomes stray light when incident on lens processing portion 34.

Diffusion plate 4 is a plate-shaped member formed so as to extend in the X-axis and the Y-axis. Diffusion plate 4 receives the second emission light emitted from second lens 3 and diffuses the second emission light in the X-axis direction. Specifically, surface 41 of diffusion plate 4 facing second lens 3 is waved. Therefore, when the second emission light is incident on diffusion plate 4, it is diffused by surface 41 of diffusion plate 4 in the positive direction or the negative direction of the X-axis.

Figure 3:
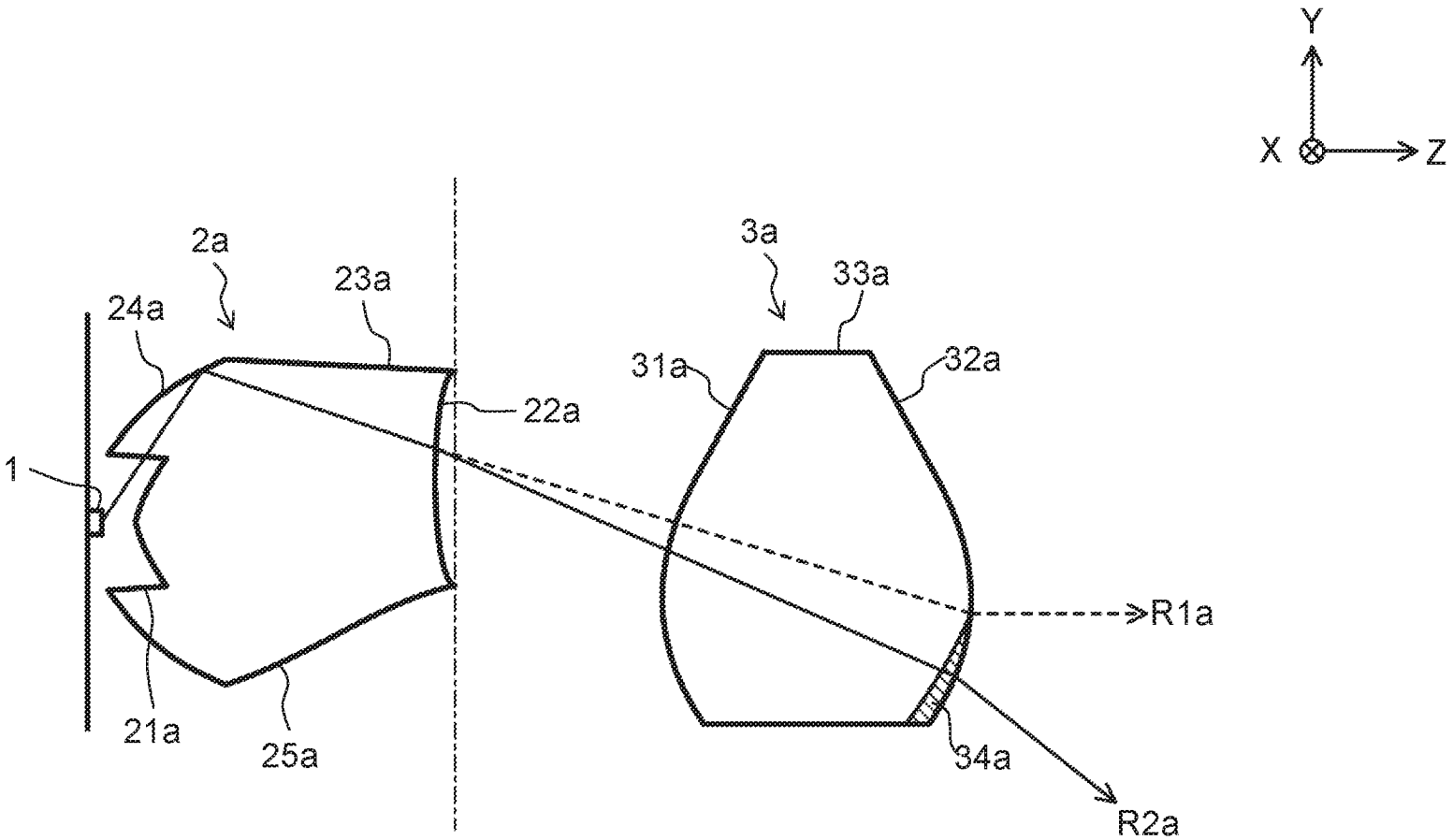
FIG. 3 is a side view of a lighting device of the related art.

FIG. 3 illustrates a side view of a lighting device of the related art. In FIG. 3, since first lens 2*a* is created by molding, first emission surface 22*a* has a concave shape. Emission light R1*a* is emission light in a case where first emission surface 22*a* is a flat surface, and emission light R2*a* is actual emission light.

Emission light R2*a* incident on first lens 2*a* from light emitting element 1 and reflected by first reflection surface 24*a* has an emission direction from first emission surface 22*a*, which is downward from emission light Ma in the drawing by the concave lens effect of first emission surface 22*a*. Since emission light R2*a* is incident on lens processing portion 34*a* of second lens 3*a*, emission light R2*a* is emitted further downward from the emission light R1*a* in the drawing. Therefore, emission light R2*a* becomes stray light.

Therefore, in FIG. 1, first lens 2 is created so that first emission surface 22 of first lens 2 has a convex shape. Specifically, first emission surface 22 has a convex shape protruding in the positive direction of the Z-axis.

As illustrated in FIG. 1, emission light R3 incident on first lens 2 from light emitting element 1 and reflected by first reflection surface 24 of first lens 2 is emitted from first emission surface 22. In this case, since first emission surface 22 is formed in the convex shape, it is refracted upward in the drawing from emission light R2*a* of FIG. 3. Therefore, emission light R3 is incident on second emission surface 32 so as not to be incident on lens processing portion 34 of second lens 3. That is, by forming first emission surface 22 in the convex shape, emission light R3 does not become stray light. Therefore, in lighting device 10 having the cutoff function, it is possible to suppress the generation of stray light while suppressing the cost. In the present exemplary embodiment, lighting device 10 can cut the light which goes to the positive direction of the Y-axis.

A relationship between first lens 2 and second lens 3 will be described.

First lens 2 and second lens 3 are disposed so as to satisfy at least one of the following expressions (1) to (3).

$$0.7\times F\leq D\leq 1.3\times F \quad (1)$$

$$0.9\times F\leq D\leq 1.1\times F \quad (2)$$

$$0.95\times F\leq D\leq 1.05\times F \quad (3)$$

Here, D is a distance from main plane S of second lens 3 to apex p1 of first emission surface 22 of first lens 2, and F is a distance from main plane S of second lens 3 to focal point f of the second lens.

Main plane S of second lens 3 passes through midpoint p4 between apex p2 of second incident surface 31 and apex p3 of second emission surface 32 of second lens 3, and is an XY plane perpendicular to the Z-axis (direction in which the optical axis of light emitting element 1 is extended). Apex p1 on first emission surface 22 is a point closest from second lens 3 on the Z-axis. Apex p2 on second incident surface 31 is a point closest from first lens 2 on the Z-axis. Apex p3 is a point on second emission surface 32 farthest from first lens 2 on the Z-axis. Focal point f is a point where the light incident on second lens 3 from first lens 2 side along the Z-axis is collected.

In order to provide lighting device 10 with a high degree of light distribution performance, it is preferable to satisfy the expression (1), more preferably the expression (2), and further preferably the expression (3).

First lens 2 is created so as to satisfy the following relationship.

$$0.003\times L\leq T \quad (4)$$

Here, L is a length of first emission surface 22 on the Y-axis. T is a distance on the Z-axis from an end (point farthest from second lens 3 on the Z-axis) of first emission surface 22 to apex p1. Accordingly, it is possible to suppress distortion of first emission surface 22 when first lens 2 is created.

First lens 2 and second lens 3 are created and disposed so as to satisfy the following expressions (5) to (7).

$$T \leq 0.1 \times F \quad (5)$$

$$T \leq 0.05 \times F \quad (6)$$

$$T \leq 0.02 \times F \quad (7)$$

Thereby, lighting device 10 can be provided with a high degree of light distribution performance. In order to provide lighting device 10 with a high degree of light distribution performance, it is preferable to satisfy the expression (5), more preferably the expression (6), and further preferably the expression (7).

OTHER EXEMPLARY EMBODIMENTS

The exemplary embodiments are described above as examples of the technique disclosed in the present application. However, the technique in the present disclosure is not limited to these, and is also applicable to exemplary embodiments in which changes, replacements, additions, omissions, and the like are appropriately made.

In the exemplary embodiment described above, first lens 2 is created through a cooling step of cooling first lens 2 after a molding step of molding with a mold or the like. First emission surface 22 of first lens 2 does not necessarily have to be formed in a convex shape during use, and may be created in a convex shape during manufacturing (particularly, during the molding step). In other words, when being used, first emission surface 22 doesn't need to be concave, and may be flat or convex. Thereby, it is possible to prevent first emission surface 22 of first lens 2 from being concave, and thus it is possible to prevent light from being incident on lens processing portion 34 of second lens 3, and the effect described above can be obtained.

In the exemplary embodiment described above, diffusion plate 4 may not be provided.

The lighting device of the present disclosure can be applied to a lighting device having a cutoff function, such as a vehicle headlight and floodlight installed on the ground.

What is claimed is:

1. A lighting device comprising:

a light emitting element;

a first lens that receives light emitted from the light emitting element and emits first emission light; and a second lens that receives the first emission light and emits second emission light, wherein the first lens has a first emission surface emitting the first emission light, the first emission surface having a convex shape protruding in a traveling direction of the light emitted from the light emitting element, wherein the second lens includes a second incident surface that receives the first emission light, and a second emission surface that is provided at a position facing the second incident surface and emits the second emission light, and wherein the first lens and the second lens are disposed so as to satisfy at least one of the following expressions (1) to (3):

$$0.7 \times F \leq D \leq 1.3 \times F \quad (1)$$

$$0.9 \times F \leq D \leq 1.1 \times F \quad (2)$$

$$0.95 \times F \leq D \leq 1.05 \times F \quad (3)$$

where, when a plane, which passes through a midpoint between an apex of the second incident surface and an apex of the second emission surface and is perpendicular to an optical axis direction, is assumed as a main plane, D is a distance from an apex of the first emission surface to the main plane, and F is a distance from a focal point of the second lens to the main plane.

2. The lighting device of claim 1, wherein the first emission surface is formed such that a curvature in a vertical direction when viewed from an optical axis direction is different from a curvature in a direction perpendicular to the vertical direction and the optical axis direction.

3. The lighting device of claim 1, wherein the second lens is an anamorphic lens formed such that a curvature in a vertical direction when viewed from an optical axis direction is different from a curvature in a direction perpendicular to the vertical direction and the optical axis direction.

4. The lighting device of claim 1, further comprising:

a diffusion plate of which a surface is formed in a wave shape and which receives the second emission light and diffuses the second emission light.

5. A method for manufacturing the first lens used in the lighting device of claim 1, the method comprising:

a molding step of molding the first lens; and a cooling step of cooling the molded first lens, wherein in the molding step, the first emission surface of the first lens emitting first emission light is formed to have the convex shape in an optical axis direction of the light emitting element.

6. A lighting device comprising:

a light emitting element;

a first lens that receives light emitted from the light emitting element and emits first emission light; and a second lens that receives the first emission light and emits second emission light, wherein the first lens has a first emission surface emitting the first emission light, the first emission surface having a convex shape protruding in a traveling direction of the light emitted from the light emitting element, and wherein the first lens is formed so as to satisfy the following expression (4):

$$0.003 \times L \leq T \quad (4)$$

where, L is a length of the first emission surface in a vertical direction, and T is a distance from an end to an apex of the first emission surface in an optical axis direction.

7. The lighting device of claim 6, wherein the first emission surface is formed such that a curvature in a vertical direction when viewed from an optical axis direction is different from a curvature in a direction perpendicular to the vertical direction and the optical axis direction.

8. The lighting device of claim 6, wherein the second lens is an anamorphic lens formed such that a curvature in a vertical direction when viewed from an optical axis direction is different from a curvature in a direction perpendicular to the vertical direction and the optical axis direction.

9. The lighting device of claim 6, further comprising:

a diffusion plate of which a surface is formed in a wave shape and which receives the second emission light and diffuses the second emission light.

10. A method for manufacturing the first lens used in the lighting device of claim 6, the method comprising:

a molding step of molding the first lens; and a cooling step of cooling the molded first lens, wherein in the molding step, the first emission surface of the first lens emitting first emission light is formed to have the convex shape in an optical axis direction of the light emitting element.

11. A lighting device comprising:

a light emitting element;

a first lens that receives light emitted from the light emitting element and emits first emission light; and a second lens that receives the first emission light and emits second emission light, wherein the first lens has a first emission surface emitting the first emission light, the first emission surface having a convex shape protruding in a traveling direction of the light emitted from the light emitting element, and wherein the first lens and the second lens are disposed so as to satisfy at least one of the following expressions (5) to (7):

$$T \leq 0.1 \times F \quad (5)$$

$$T \leq 0.05 \times F \quad (6)$$

$$T \leq 0.02 \times F \quad (7)$$

where, T is a distance from an end to an apex of the first emission surface in an optical axis direction, and when a plane, which passes through a midpoint between an apex of the second incident surface and an apex of the second emission surface, and is perpendicular to the optical axis direction, is assumed as the main plane, F is a distance from a focal point of the second lens to a main plane.

12. The lighting device of claim 11, wherein the first emission surface is formed such that a curvature in a vertical direction when viewed from an optical axis direction is different from a curvature in a direction perpendicular to the vertical direction and the optical axis direction.

13. The lighting device of claim 11, wherein the second lens is an anamorphic lens formed such that a curvature in a vertical direction when viewed from an optical axis direction is different from a curvature in a direction perpendicular to the vertical direction and the optical axis direction.

14. The lighting device of claim 11, further comprising:

a diffusion plate of which a surface is formed in a wave shape and which receives the second emission light and diffuses the second emission light.

15. A method for manufacturing the first lens used in the lighting device of claim 11, the method comprising:

a molding step of molding the first lens; and a cooling step of cooling the molded first lens, wherein in the molding step, the first emission surface of the first lens emitting first emission light is formed to have the convex shape in an optical axis direction of the light emitting element.

* * * * *